US010065433B1

(12) United States Patent
Boland et al.

(10) Patent No.: US 10,065,433 B1
(45) **Date of Patent: *Sep. 4, 2018**

(54) CONCENTRIC ARRANGEMENT OF WEB CONDITIONING MODULES IN A DRYER OF A PRINT SYSTEM

(71) Applicants: Stuart James Boland, Denver, CO (US); Dilan Nirushan Fernando, Thornton, CO (US); Scott Richard Johnson, Erie, CO (US)

(72) Inventors: Stuart James Boland, Denver, CO (US); Dilan Nirushan Fernando, Thornton, CO (US); Scott Richard Johnson, Erie, CO (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/877,024

(22) Filed: Jan. 22, 2018

Related U.S. Application Data

(63) Continuation of application No. 15/442,690, filed on Feb. 26, 2017, now Pat. No. 9,908,342.

(51) Int. Cl.
*B41J 11/00* (2006.01)
*F26B 13/00* (2006.01)

(52) U.S. Cl.
CPC ..... *B41J 11/0015* (2013.01); *B41J 11/002* (2013.01); *F26B 13/00* (2013.01)

(58) Field of Classification Search
CPC ..... F26B 13/00
See application file for complete search history.

(56) References Cited

U.S. PATENT DOCUMENTS

| | | | | |
|---|---|---|---|---|
| 1,961,182 | A | 6/1934 | Williams | D21F 5/02 34/114 |
| 3,952,421 | A | 4/1976 | Wilson | D21F 5/00 219/774 |
| 5,770,015 | A | 6/1998 | Grossmann | D21F 5/04 162/206 |
| 9,605,900 | B2 | 3/2017 | Boland | F26B 13/14 |
| 9,908,342 | B1 * | 3/2018 | Boland | B41J 11/0015 |

(Continued)

OTHER PUBLICATIONS

PTO-892 cited in parent U.S. Appl. No. 15/442,690.*
PTO-1449 cited in parent U.S. Appl. No. 15/442,690.*

*Primary Examiner* — Huan Tran
(74) *Attorney, Agent, or Firm* — Duft Bornsen & Fettig LLP

(57) ABSTRACT

Systems and methods for concentric arrangement of web conditioning modules in a dryer of a printing system. In one embodiment a dryer includes a drum, first rollers positioned in an arc around the drum to define a web path between an entrance of the dryer and the drum, and second rollers positioned along the arc between the first rollers and the drum that reverse the web path between the drum and an exit of the dryer. The dryer further includes first web conditioners positioned along the arc and beyond the first rollers from the drum that direct energy toward a portion of the web path that is between the entrance of the dryer and the drum. The dryer further includes second web conditioners positioned along the arc between the second rollers and the drum that direct energy toward a portion of the web path that wraps around the drum.

20 Claims, 11 Drawing Sheets

(56) References Cited

U.S. PATENT DOCUMENTS

| | | | | |
|---|---|---|---|---|
| 2015/0346659 | A1* | 12/2015 | Nagayama | G03G 15/2039 101/424.1 |
| 2016/0313059 | A1 | 10/2016 | Boland | F26B 13/18 |
| 2017/0153059 | A1 | 6/2017 | Boland | F26B 13/18 |

* cited by examiner

CONCENTRIC ARRANGEMENT OF WEB CONDITIONING MODULES IN A DRYER OF A PRINT SYSTEM

RELATED APPLICATIONS

This document is a continuation of co-pending U.S. patent application Ser. No. 15/442,690 (filed on Feb. 26, 2017) titled, "CONCENTRIC ARRANGEMENT OF WEB CONDITIONING MODULES IN A DRYER OF A PRINT SYSTEM," which is hereby incorporated by reference.

FIELD OF THE INVENTION

The invention relates to the field of printing systems, and in particular, to dryers of printing systems.

BACKGROUND

Businesses or other entities having a need for volume printing typically use a production printing system capable of printing hundreds of pages per minute. A web of print media, such as paper, is stored in the form of a large roll and unraveled as a continuous sheet. During printing, the web is quickly passed underneath printheads which discharge small drops of ink at particular intervals to form pixel images on the web. The web may then be dried and cut to produce a final printed product.

Since production printers output high quality images at high speed, it is important that the drying process of the web is quick, effective, and efficient. One such drying mechanism is a hollow metal drum heated with a radiant energy source such as a lamp. The lamp heats the surface of the drum to a desired temperature and the web contacts the heated rotating surface of the drum to dry ink on the web at a controlled temperature. However, conventional drum dryers have limited options for conditioning the web with multiple dryer components.

SUMMARY

Embodiments described herein provide a concentric arrangement of web conditioning modules in a dryer of a printing system. A center of the dryer includes a drum and there is a concentric arrangement of components around the drum. In an order starting nearest to the drum, the dryer includes a semi-circle of conditioning modules, a semi-circle of rollers, another semi-circle of rollers, and another semi-circle of conditioning modules. The conditioning modules may include various combinations of components that eject air or heat toward a web of print media, and the rollers define a media path for the web that is spiral-like to extend the options for conditioning the web inside the dryer. In addition to precise control of web conditioning, the concentric configuration allows efficient energy use even for high heat applications. Further embodiments improve the accessibility to the concentric arrangement of components for installation and maintenance operations.

One embodiment is a system that includes a dryer of a printing system. The dryer includes a drum configured to rotate about an axis, and to apply heat to a web of print media to dry ink applied to the web. The dryer also includes first rollers positioned in an arc around the drum to define a web path along the arc between an entrance of the dryer and the drum, and second rollers positioned along the arc and radially between the first rollers and the drum, the second rollers reverse the web path along the arc between the drum and an exit of the dryer. The dryer further includes first web conditioners positioned along the arc and radially beyond the first rollers from the drum, the first web conditioners configured to direct conditioning toward a portion of the web path that is between the entrance of the dryer and the drum. The dryer also further includes second web conditioners positioned along the arc and radially between the second rollers and the drum, the second web conditioners configured to direct conditioning toward a portion of the web path that wraps around the drum.

The above summary provides a basic understanding of some aspects of the specification. This summary is not an extensive overview of the specification. It is not intended to identify key or critical elements of the specification nor to delineate any scope of particular embodiments of the specification, or any scope of the claims. Its sole purpose is to present some concepts of the specification in a simplified form as a prelude to the more detailed description that is presented later. Other exemplary embodiments may be described below.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific exemplary embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
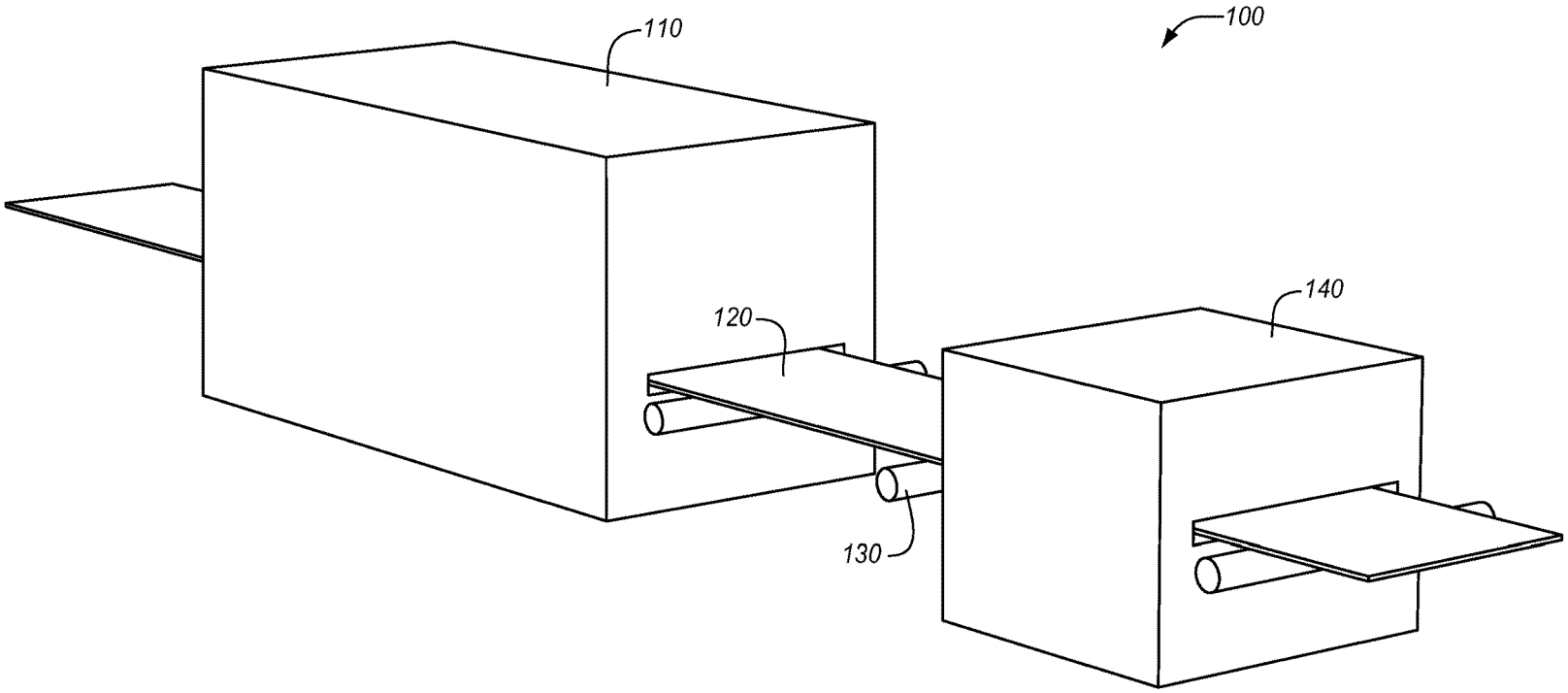
FIG. 1 illustrates an exemplary continuous-forms printing system.

FIG. 1 illustrates an exemplary continuous-forms printing system 100. Printing system 100 includes production printer 110, which is configured to apply ink onto a web 120 of continuous-form print media (e.g., paper). As used herein, the word "ink" is used to refer to any suitable marking fluid (e.g., aqueous inks, oil-based paints, etc.). Printer 110 may comprise an inkjet printer that applies colored inks, such as Cyan (C), Magenta (M), Yellow (Y), Key (K) black, white, or clear inks. The ink applied by printer 110 onto web 120 is wet, meaning that the ink may smear if it is not dried before further processing. One or more rollers 130 position web 120 as it travels through printing system 100. Printing system 100 also includes drying system 140, which is any system, apparatus, device, or component operable to dry ink applied to web 120. Printer 110 is upstream from the dryer since web 120 travels downstream from printer 110 to drying system 140. Printer 110 and drying system 140 may be separate devices or one integrated device.

Figure 2:
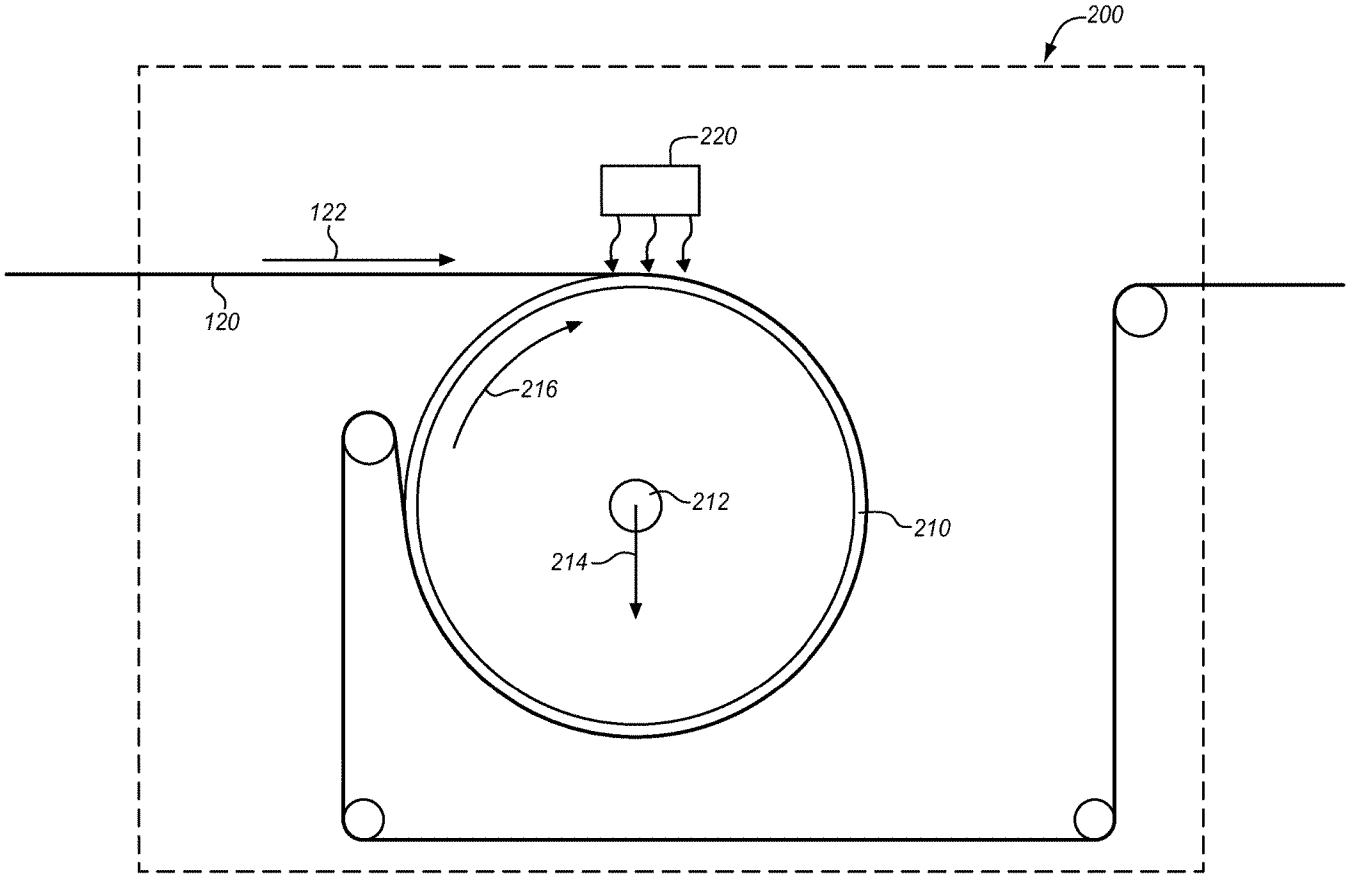
FIG. 2 illustrates a side view of a drying system that includes a drum in an exemplary embodiment.

FIG. 2 illustrates a side view of a drying system 200 that includes a drum 210 in an exemplary embodiment. In general, drum 210 includes a cylindrical body with a thermally conductive surface on its outer circumference. During operation, web 120 is marked with ink by a print engine, enters drying system 200 as it travels along web travel direction 122, and wraps around an outer surface of rotating drum 210, which is heated to a desired temperature via heat transfer of a radiant energy source 220 (which may be positioned external to drum 210 as shown and/or positioned internally in an area inside drum 210). Drum 210 rotates about axis 212, and components of drying system 200 may therefore be described with respect to a radial direction 214 which is any direction along a straight line from axis 212 or center of drum 210, and a circumferential direction 216 which is analogous to a rotational direction of drum 210 that is perpendicular to radial direction 214. Although drum 210 provides consistent and even heating of web 120, conventional drying systems such as that shown in FIG. 2 have a relatively low degree of drying adaptability since the total path length of web 120 is constant and relatively short and drying adjustments are limited to simply increasing/decreasing heat output of radiant energy source 220 for corresponding temperature changes on surface of drum 210.

Figure 3:
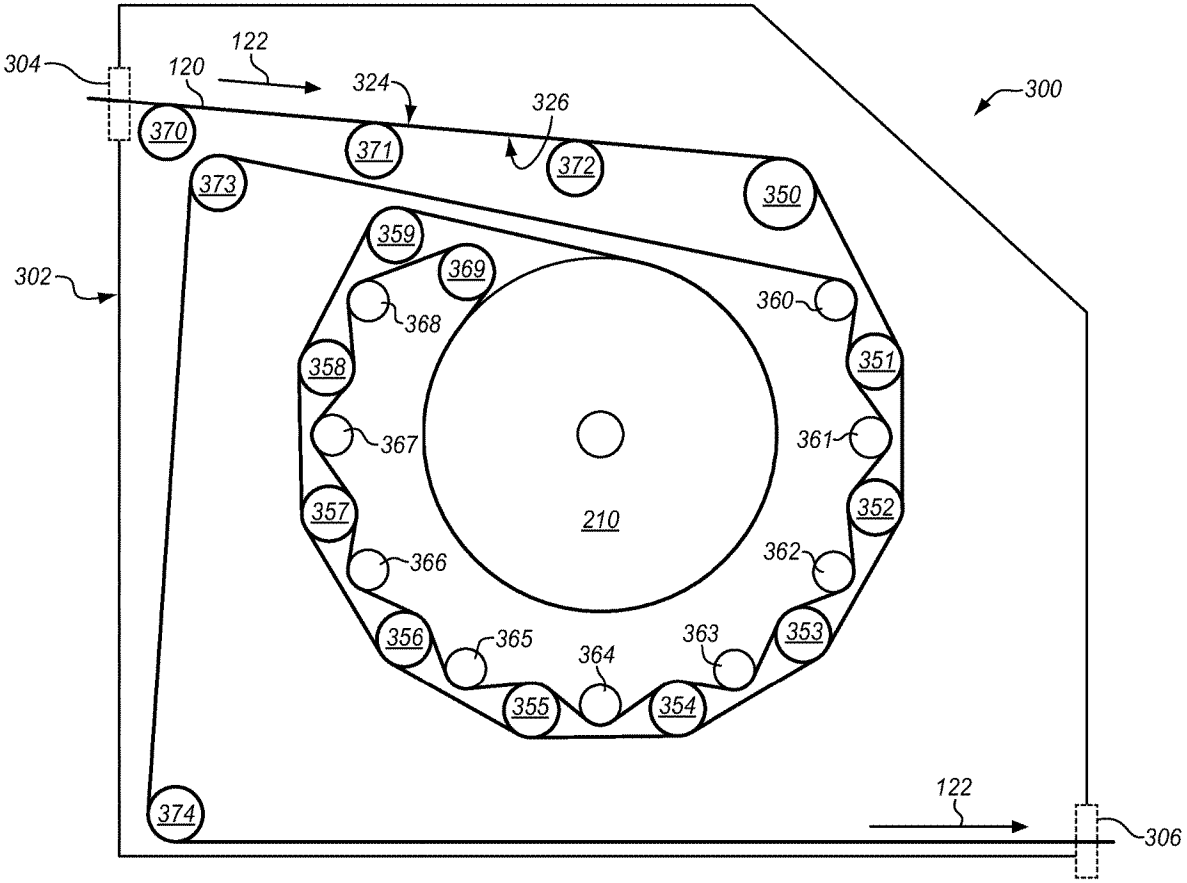
FIG. 3 illustrates a drying system enhanced with a roller configuration and improved web conditioning in an exemplary embodiment.

FIG. 3 illustrates a drying system 300 enhanced with a roller configuration and improved web conditioning in an exemplary embodiment. Dryer 300 may be used in place of dryer 140 of FIG. 1. In general, drying system 300 includes two groups of rollers: a series of first rollers 350-359 spaced along an arc around drum 210, and a series of second rollers 360-369 spaced along the arc around drum 210. Drum 210 is generally positioned inside the arc and has a larger circumference than rollers 350-359/360-369, and the positioning of rollers 350-359/360-369 generally defines the arc and the path for web 120 to follow inside enclosure 302. That is, the web path in drying system 300 is a passage for web 120 to follow from dryer entrance 304 to dryer exit 306 and is determined by the engaged surfaces of drum 210 and rollers 350-359/360-369. The web paths are shown in the figures by the line of web 120.

After printing, web 120 enters an enclosure 302 of drying system 300 at dryer entrance 304 with a marked side 324 that is wet with an applied ink and an unmarked side 326 that does not have ink (or which has been previously marked and already dried). Web 120 may travel over one or more entrance rollers 370-372 before encountering the first rollers 350-359. The first rollers 350-359 transport (i.e., guide) web 120 along a first path of the arc in a first direction (e.g., clockwise direction or first circular direction). One or more of the first rollers 350-359 may be heated internally or externally for drying ink applied to web 120. A roller (e.g., roller 359) among the first rollers 350-359 which is last along the arc turns web 120 toward drum 210. Web 120 then wraps around a circumferential portion drum 210 which applies further heat to web 120.

After traveling around drum 210, web 120 encounters the second rollers 360-369. A roller (e.g., roller 369) among the second rollers 360-369 which is first to receive web 120 from drum 210 may be positioned adjacent to the last roller (e.g., roller 359) of the first rollers 350-359. Accordingly, rollers 369/359 may tension/transport web 120 around a substantial circumferential portion of drum 210 (e.g., wrap/contact angle of 300 degrees or more). The second rollers 360-369 transport web 120 along a second path of the arc in a second direction which is generally opposite from the first direction (e.g., counter-clockwise direction or a second circular direction opposite to the first circular direction). Second rollers 360-369 are positioned along the arc and radially between first rollers 350-359 and drum 210. After traveling the arc again in the reversed (i.e., opposite) direction, web 120 may travel over one or more exit rollers 373-374 before leaving drying system 300 through dryer exit 306 of enclosure 302.

As shown in FIG. 3, one or more of the first rollers 350-359 and one or more of the second rollers 360-369 may interlace with one another. An interlaced roller configuration refers to a relative position between a first roller (e.g., one or more of first rollers 350-359) and a second roller (e.g., one or more of second rollers 360-369) in which the rollers have opposite rotation directions, overlap along the radial direction 214, and are offset from one another in a direction perpendicular to the radial direction 214 (e.g., circumferential direction 216 in drying system 300 and/or travel direction of web 120). In other words, the second rollers 360-369 may occupy the spaces between the first rollers 350-359 along the arc or circumferential direction 216 such that web 120 alternates contact with second rollers 360-369 and first rollers 350-359 as it travels in the second direction between drum 210 and dryer exit 306.

The amount of overlap, or relative distance between a second roller 360-369 and a first roller 350-359 along the radial direction 214, imparts a corresponding amount of contact/heat between web 120 and the first rollers 350-359 as web 120 travels in the second direction. Though ink applied to the marked side 324 of web 120 may be sufficiently dry so as not to smear by the time it begins to contact the second rollers 360-369 (e.g., second roller 369 that first receives web 120 from drum 210), it may be desirable for a number of reasons to further transfer heat to web 120 with the first rollers 350-359 to condition web 120 for sufficient print/drying quality. Thus, when drying system 300 is configured with interlaced rollers, web 120 may be dried via heated contact between the unmarked side 326 of web 120 and a first circumferential portion of each of the first rollers 350-359 (e.g., referred to as an outer circumferential portion of rollers 350-359 that faces generally away from drum 210 along the radial direction 214) as web 120 travels in the first direction along the arc. Web 120 may be further dried via heated contact between the unmarked side 326 of web 120 and a second circumferential portion of each of the first rollers 350-359 (e.g., referred to as an inner circumferential portion of rollers 350-356 that faces generally toward drum 210 along radial direction 214) as web 120 travels in the second direction along the arc in a reverse direction but which now interleaves in a zigzag pattern between the second rollers 360-369 and the first rollers 350-359.

As further illustrated in FIG. 3, a roller (e.g., roller 369) among the second rollers 360-369 which is first to receive web 120 from drum 210 may be positioned closer to drum 210 along the radial direction 214 than other second rollers (e.g., rollers 368-360) which may be positioned in an interlaced configuration described above. In other words, rollers 359/369 which tension/transport web 120 around drum 210 may be positioned in a non-interlacing configuration such that web 120 does not contact first roller 359 as it travels between second roller 369 and second roller 368. The closer position of the second roller 369 to drum 210 enables a relatively large wrap angle of web 120 around drum 210 (e.g., 300 degrees or more) while avoiding interference with other portions of the web path as web 120 reverses direction in enclosure 302. That is, the second roller 369 is positioned along the radial direction 214 between drum 210 and the portion of web 120 traveling between the first roller 359 and drum 210. In one embodiment, one or more of first rollers 350-359 and one or more of second rollers 360-369 may be adjustable with respect to one another along the radial direction 214. For example, rollers 350-359/360-369 may disengage to a non-interlacing position (e.g., for paper threading, roller cleaning, a particular drying application, etc.) and/or to adjust the amount of interlacing to cause a corresponding adjustment in wrap angle or heat applied to web 120.

In this configuration with rollers 350-359 and 360-369 in curved patterns that define a spiral-like web path around drum 210, there is an increased path length in comparison with conventional drum dryers and therefore an increased number of options for conditioning web with precise control. Furthermore, the roller configuration enables efficient use of drum 210 and an increased number of heat contactable surfaces for web 120 in embodiments in which one or more of first rollers 350-359 are heated. As described in greater detail below, the particular positions of drum 210, the first rollers 350-359, and the second rollers 360-369 also enables numerous configurations of drying system 300 for conditioning web 120.

Figure 4:
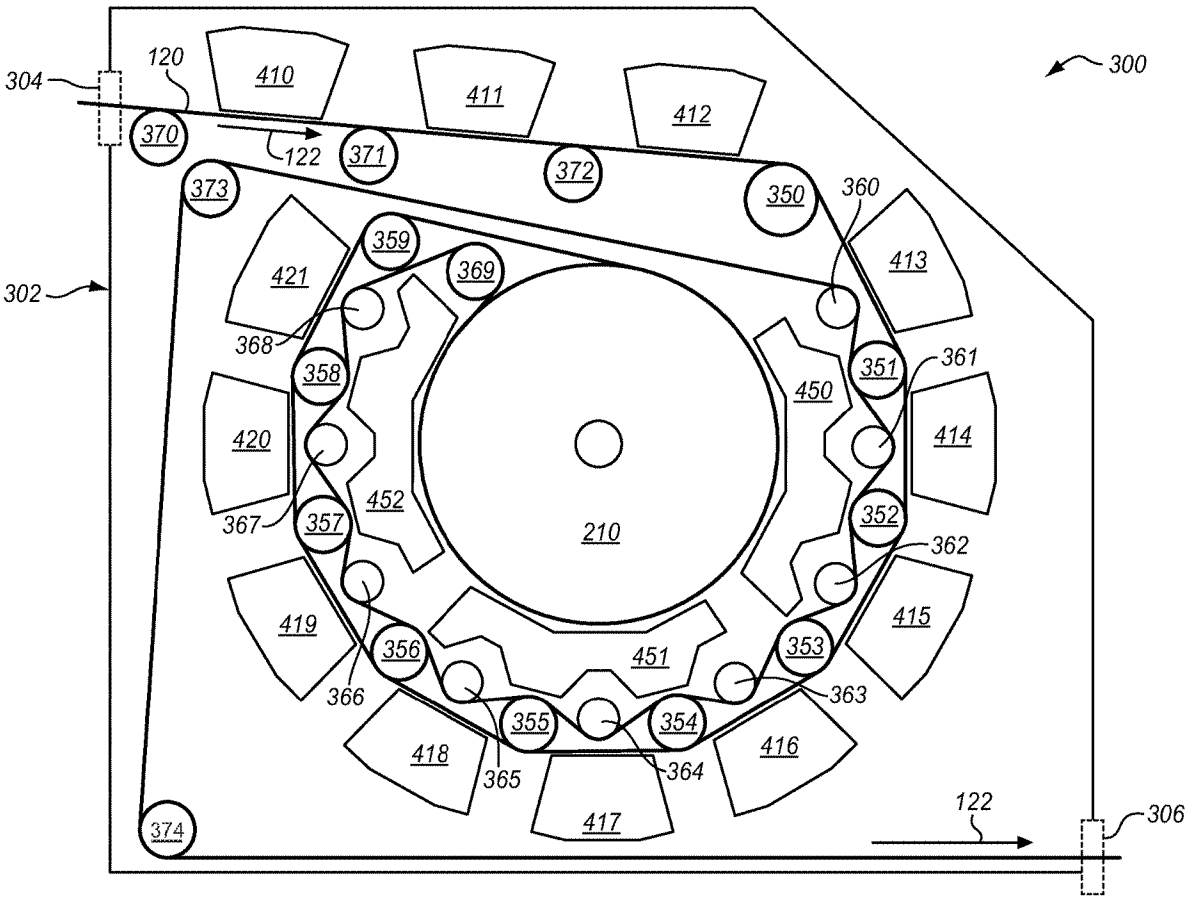
FIG. 4 illustrates a drying system that includes a drum and a concentric arrangement of drying components in an exemplary embodiment.

FIG. 4 illustrates drying system 300 that includes drum 210 and a concentric arrangement of drying components in an exemplary embodiment. The configuration is generally similar to that already described for FIG. 3 in that the first rollers 350-359 and the second rollers 360-369 are positioned in an arc around drum 210. In addition, drying system 300 includes a series of first web conditioners 410-421 positioned along the arc and radially beyond first rollers 350-359 from drum 210. First web conditioners 410-421 may include radiant energy sources that direct (i.e., emit) radiant heat energy (e.g., infrared (IR) or near-infrared (NIR) energy) toward the marked side 324 of web 120 as web 120 travels along the arc toward drum 210. Alternatively or additionally, first web conditioners 410-421 may include air knives that emit air jets toward the marked side 324 of web 120 as web 120 travels along the arc toward drum 210. First web conditioners 410-421 therefore direct energy, or web conditioning (e.g., radiant heat, jetted air, or some combination thereof) toward a portion of the web path that is between the dryer entrance 304 and drum 210. One or more first web conditioners 410-421 may optionally be positioned over entrance rollers 370-372 which are not arranged along the arc (e.g., first web conditioners 410-412 as shown in FIG. 4).

Alternatively or additionally, drying system 300 may include a series of second web conditioners 450-452 positioned along the arc and radially between second rollers 360-369 and drum 210. Second web conditioners 450-452 may include one or more air knives, one or more radiant energy sources, or some combination thereof. In embodiments in which second web conditioners 450-452 include one or more air knives, the air knives may emit air jets toward the marked side 324 of web 120 as web 120 wraps around drum 210. Alternatively or additionally, the air knives may emit air jets toward the marked side 324 of web 120 as web 120 travels over second rollers 360-369. In embodiments in which second web conditioners 450-452 include one or more radiant energy sources, the radiant energy sources may emit heat energy toward the marked side 324 of web 120 as web 120 wraps around drum 210. Second web conditioners 450-452 may also be of the same shape and/or function as first web conditioners 410-421. Alternatively or additionally, the radiant energy sources may emit heat energy toward the marked side 324 of web 120 as web 120 travels over second rollers 360-369. Put another way, second web conditioners 450-452 may direct energy, or web conditioning (e.g., radiant heat, jetted air, or some combination thereof) toward a portion of the web path that wraps around drum 210 and/or direct energy, or web conditioning toward a portion of the web path that is between the dryer entrance 304 and drum 210.

As shown in FIG. 4, drum 210 may be positioned at or near a relative center of enclosure 302 and components are positioned along concentric arcs around drum 210 which are spaced from one another in the radial direction 214. In one embodiment, the first arc closest to drum 210 includes second web conditioners 450-452, the second arc includes second rollers 360-369, the third arc includes first rollers 350-359 (e.g., centers of the second rollers 360-369 closer to drum 210 than centers of the first rollers 350-359), and the fourth arc is furthest from drum 210 and includes first web conditioners 410-421. Each arc may span a substantial circumferential portion of drum 210 (e.g., 270 degrees or more). The arc(s) may also comprise semi-circle or circular shaped paths that have a uniform distance from the circumference of drum 210 and/or to other arcs as shown in FIG. 4. However, alternative arc span amounts, non-uniform arc paths, non-circular arc paths, and combinations of different arcs are possible within drying system 300. Additionally, drying system 300 may implement a different number or combination of components in arc(s) other than that explicitly shown and described.

Figure 5:
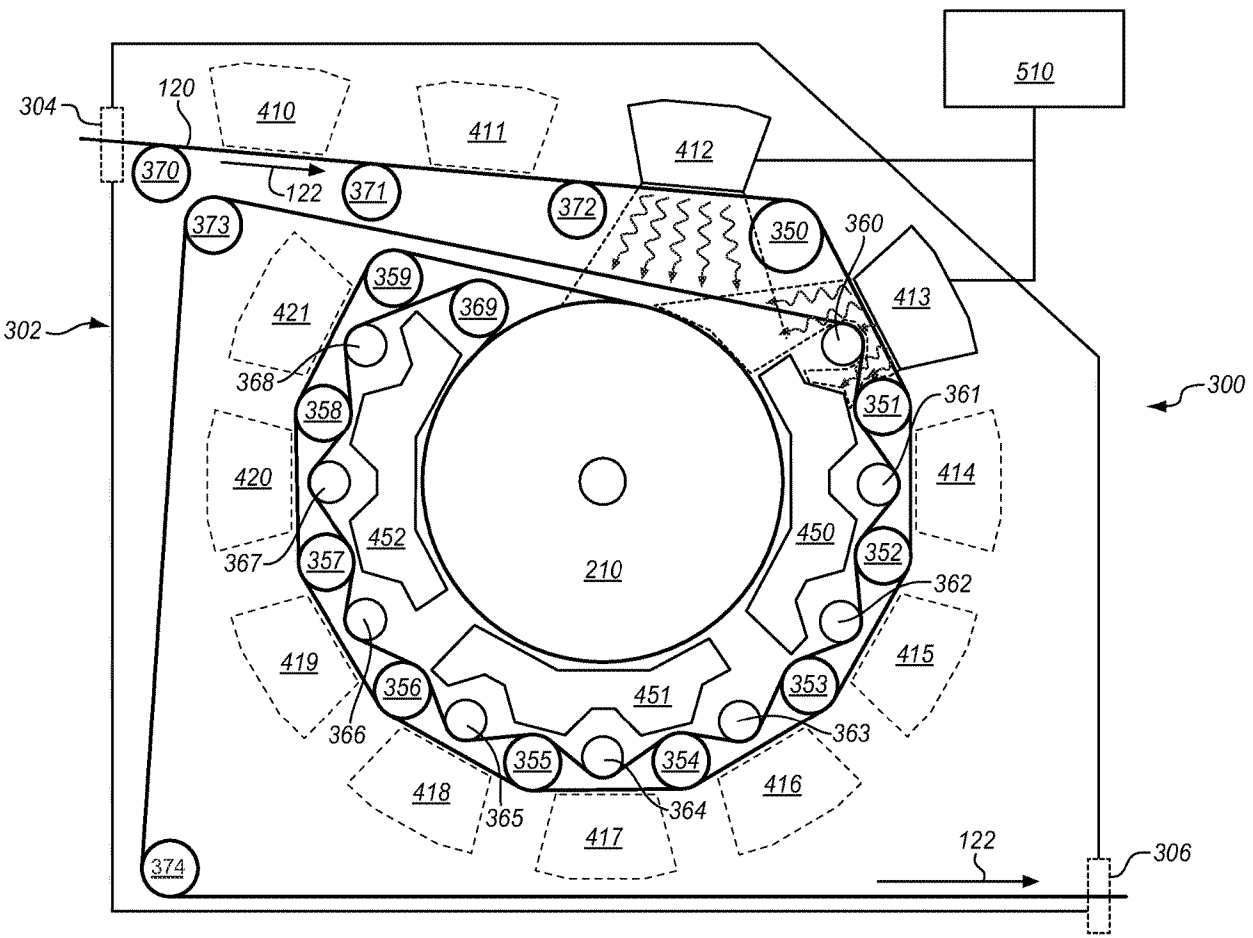
FIG. 5 illustrates a drying system with a concentric arrangement with controlled web conditioning in an exemplary embodiment.

FIG. 5 illustrates drying system 300 with a concentric arrangement with controlled web conditioning in an exemplary embodiment. Drying system 300 includes a similar configuration as that shown and described in FIG. 4. In this example, drying system 300 further includes controller 510 to selectively control an output of first web conditioners 410-421 and/or second web conditioners 450-452. Controller 510 may thus deactivate one or more first web conditioners 410-421 and/or second web conditioners 450-452 based on a desired conditioning of web 120 (e.g., first web conditioners 410-411 and 414-421 shown as deactivated in FIG. 5).

Alternatively or additionally, controller 510 may selectively control an output of external/internal heat sources of drum 210 and/or one or more first rollers 350-359. Therefore, controller 510 may be electrically/communicatively coupled with one or more first web conditioners 410-421, second web conditioners 450-452, internal/external heating sources of one or more first rollers 350-359 and/or drum 210 in any desired combination for directing a customized conditioning of web 120. Accordingly, controller 510 may adapt conditioning of web 120 to a variety of printer/dryer related variables such as types of web 120, types of print jobs, ink amounts applied to web 120, etc. Controller 510 may be implemented as custom circuitry, as a processor executing programmed instructions, etc.

As shown in FIG. 5, first web conditioners (e.g., 413-421) may be offset along the arc relative to first rollers 350-359 to direct conditioning in spaces between first rollers 350-359 and toward a portion of the web path that is between the dryer entrance 304 and drum 210. In one example, one or more first rollers 350-359 include a thermally conductive material that heats to a desired temperature via radiant energy sources of first web conditioners 450-452 which are positioned between the first rollers 350-359 along the arc in the circumferential direction 216. Second rollers 360-369 (and/or entrance/exit rollers 370-374) may include non-conductive material that is ambient or near ambient during operation of the radiant energy sources. In this configuration, web 120 may receive heat via the first rollers 350-359 and the radiant energy sources as web 120 travels in the first direction, and heat energy passing through web 120 may be recovered at inner concentric areas for efficient energy use in drying system 300. Furthermore, one or more of each of the first rollers 350-359, first web conditioners 410-421, and/or second web conditioners 450-452 may apply energy or web conditioning toward the path of web 120 in an alternating fashion along the arc. In one embodiment, the applied energy or web conditioning is not the same at all regions of the path of web 120 and sections of the web 120 receive the applied energy or web conditioning in an alternating fashion as it traverses the path of web 120. However, it will be appreciated that any of the rollers of drying system 300 may be selectively heated, cooled, or ambient in temperature in any number of combinations to provide a desired transfer of thermal energy to web 120, and may also be driven, idle, rotatable, or non-rotatable in any number of configurations. Furthermore, air knives of second web conditioners 450-452 and/or first web conditioners 410-421 may be heated, ambient, or cooled in any number of combinations. Air knives may also include an air return path to exhaust moist air created near a surface of web 120 as a result of impinging air jets. The air return path may have a negative air pressure to evacuate the moist air.

Figure 6:
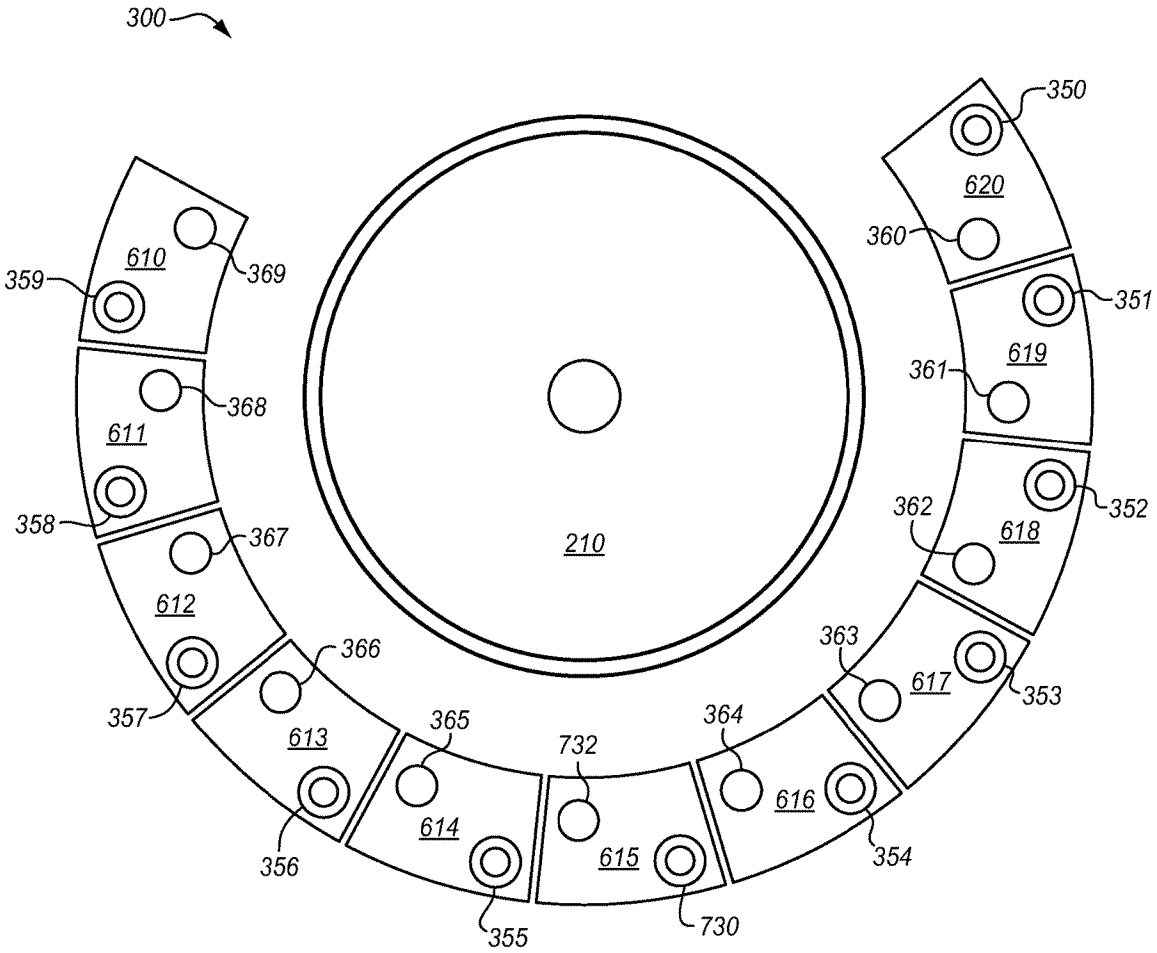
FIG. 6 illustrates a drying system with a modular concentric arrangement of drying components in an exemplary embodiment.

FIG. 6 illustrates a drying system 300 with a modular concentric arrangement of drying components in an exemplary embodiment. Drying system 300 is enhanced with roller assemblies 610-620 that each include at least one first roller 350-359 and at least one second roller 360-369 mounted to a frame. The roller assemblies 610-620 are positioned along the arc around drum 210 such that rollers 350-359/360-369 define a path for web 120 around drum 210 in a similar configuration as already described above. As described in greater detail below, the frame of each roller assembly 610-620 may be detachably fixed inside drying system 300 for improved access to components of drying system 300 for installation and maintenance procedures.

Figure 7:
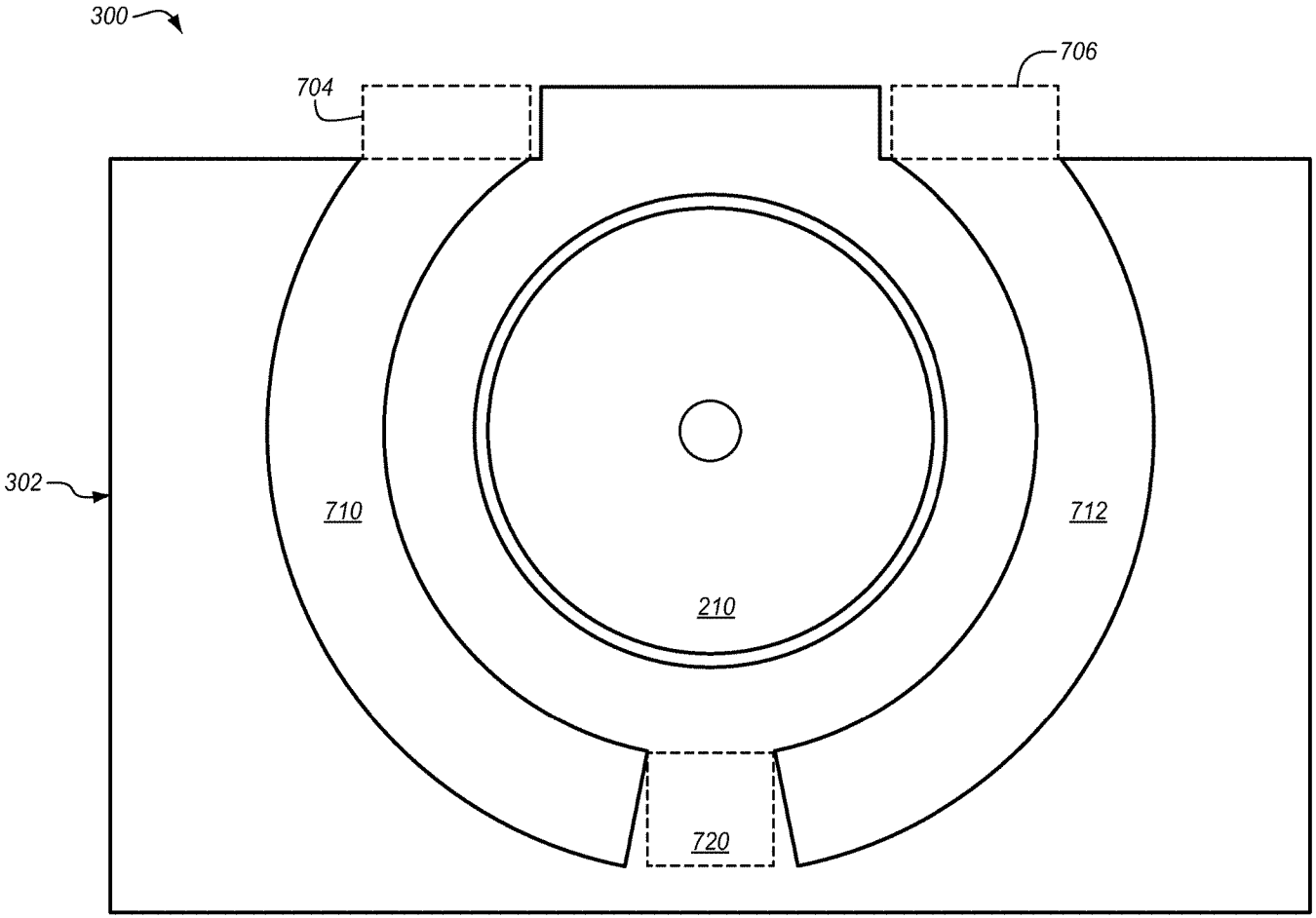
FIG. 7 illustrates a drying system with a track for a modular concentric arrangement of drying components in an exemplary embodiment.

FIG. 7 illustrates drying system 300 with a track 710 for a modular concentric arrangement of drying components in an exemplary embodiment. Drying system 300 includes tracks 710/712 which surround drum 210 along the arc. A first end of tracks 710/712 may terminate at respective openings 704/706 in a top or side of enclosure 302 of drying system 300. A second end of tracks 710/712 may terminate at a terminal section 720 which defines a space between the second ends of track 710 and track 712. As described in greater detail below, tracks 710/712 define an arced space around drum 210 that is sized to fit roller assemblies 610-620.

Figure 8:
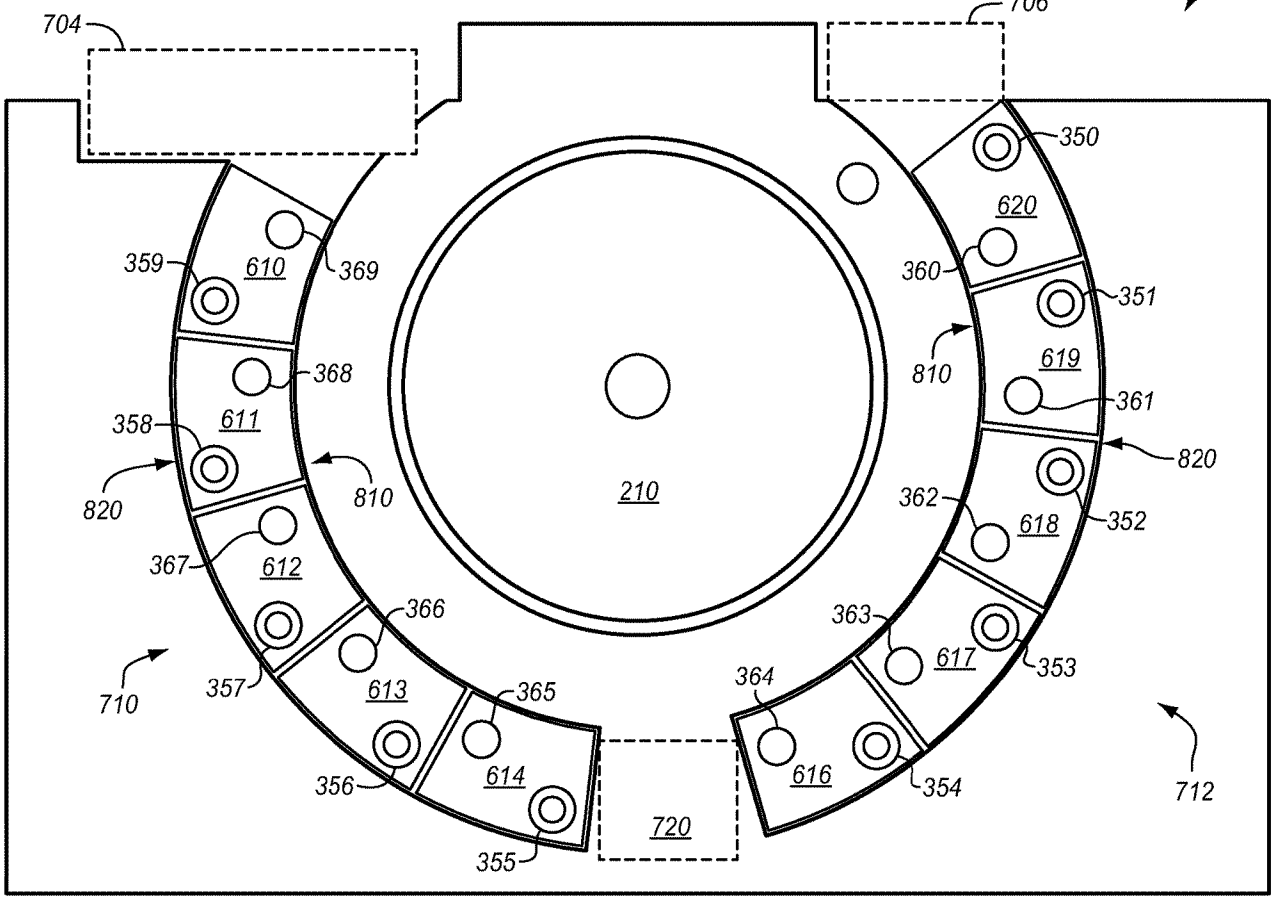
FIG. 8 illustrates a drying system with roller assemblies along tracks in an exemplary embodiment.

FIG. 8 illustrates drying system 300 with roller assemblies 610-620 along tracks 710/712 in an exemplary embodiment. Tracks 710/712 may each include an inner rail 810 and outer rail 820 that support/guide frames of roller assemblies 610-620 along the arced shape of tracks 710/712. A near side and far side of each of the frames of roller assemblies 610-620 (with respect to drum 210) may slide along inner rail 810 and outer rail 820, respectively. Accordingly, roller assemblies 610-620 may be removed from openings 704/706 in enclosure 302.

Figure 9:
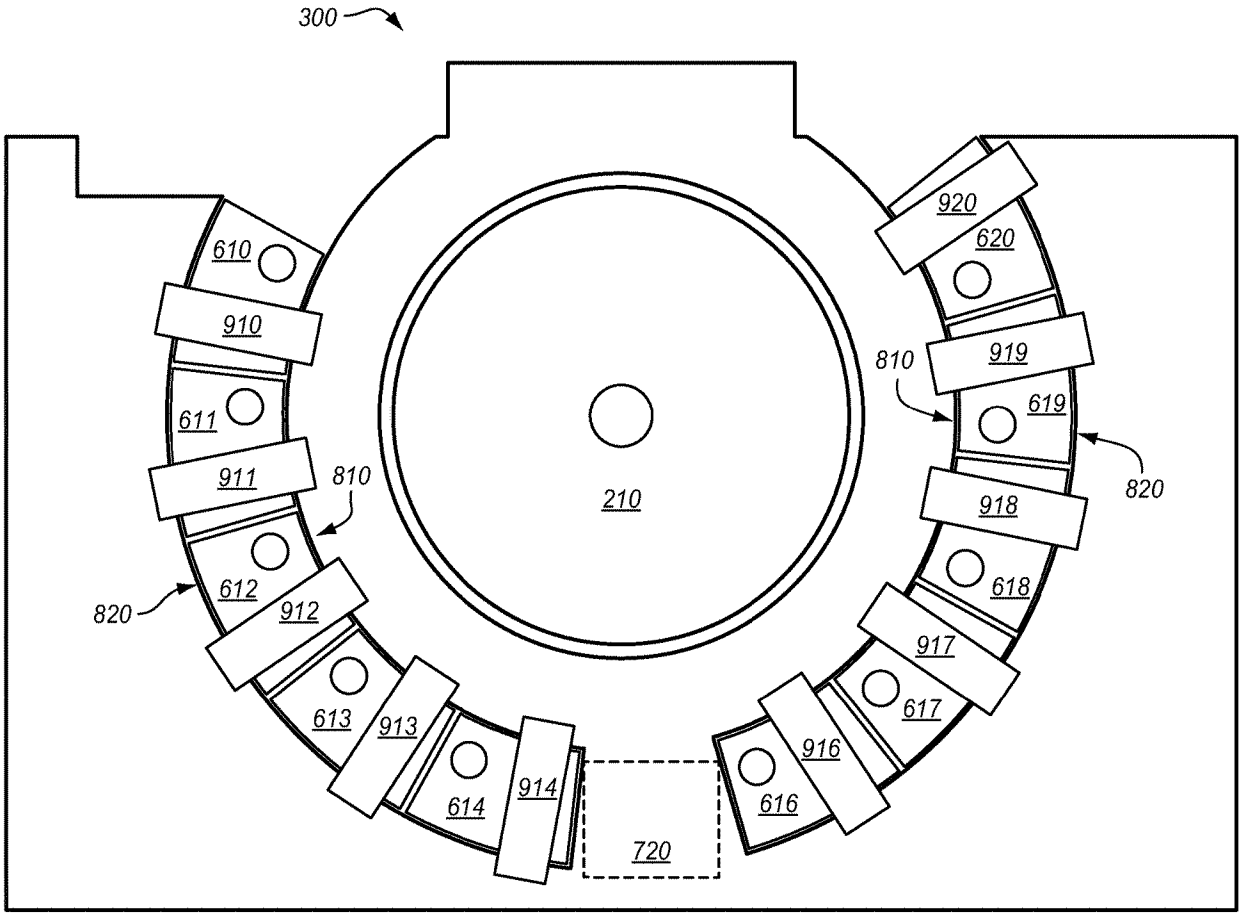
FIG. 9 illustrates a drying system with electrical connectors for roller assemblies in an exemplary embodiment.

FIG. 9 illustrates drying system 300 with electrical connectors 910-920 for roller assemblies 610-620 in an exemplary embodiment. Each electrical connector 910-920 may power one or more first rollers 350-359 that belong to each roller assembly 610-620. For example, electrical connector 910-920 may establish a connection between controller 510, a power source, and/or one or more internal/external radiant energy sources that heat one of first rollers 350-359.

Figure 10:
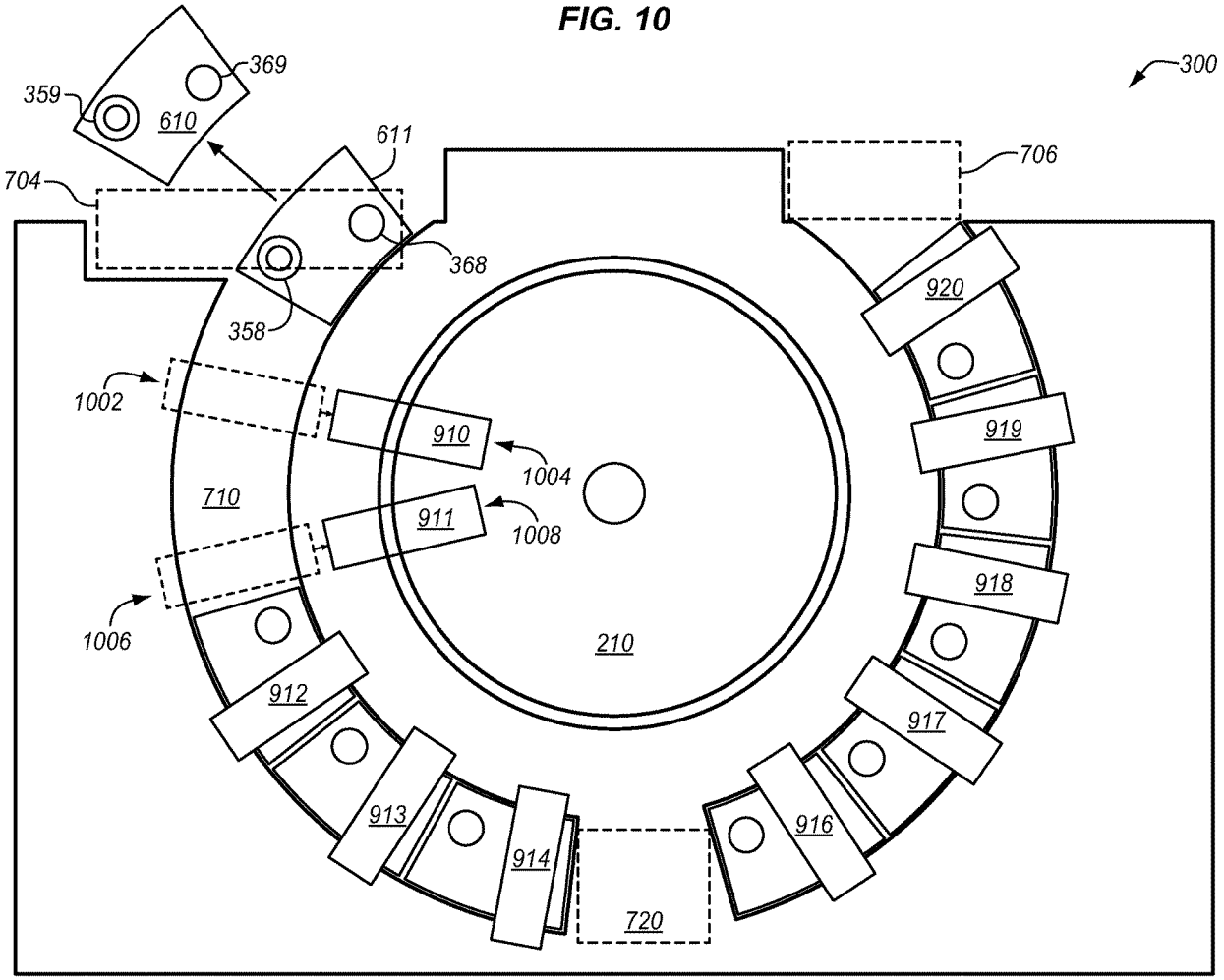
FIG. 10 illustrates a drying system with detachable electrical connectors for roller assemblies in an exemplary embodiment.

FIG. 10 illustrates drying system 300 with detachable electrical connectors 910-920 for roller assemblies 610-620 in an exemplary embodiment. Each electrical connector 910-920 may be detachably fixed to a frame of a roller assembly 610-620. For example, FIG. 10 illustrates electrical connector 910 configured to slide along the radial direction 214 from a first position 1002 to a second position 1004 to detach from a frame of roller assembly 610 such that roller assembly 610 may slide along track 710 for removal via opening 704. Similarly, electrical connector 911 of roller assembly 611 may be moved between a first position 1006 and a second position 1008 to remove or attach assembly 611 to/from enclosure 302.

Figure 11:
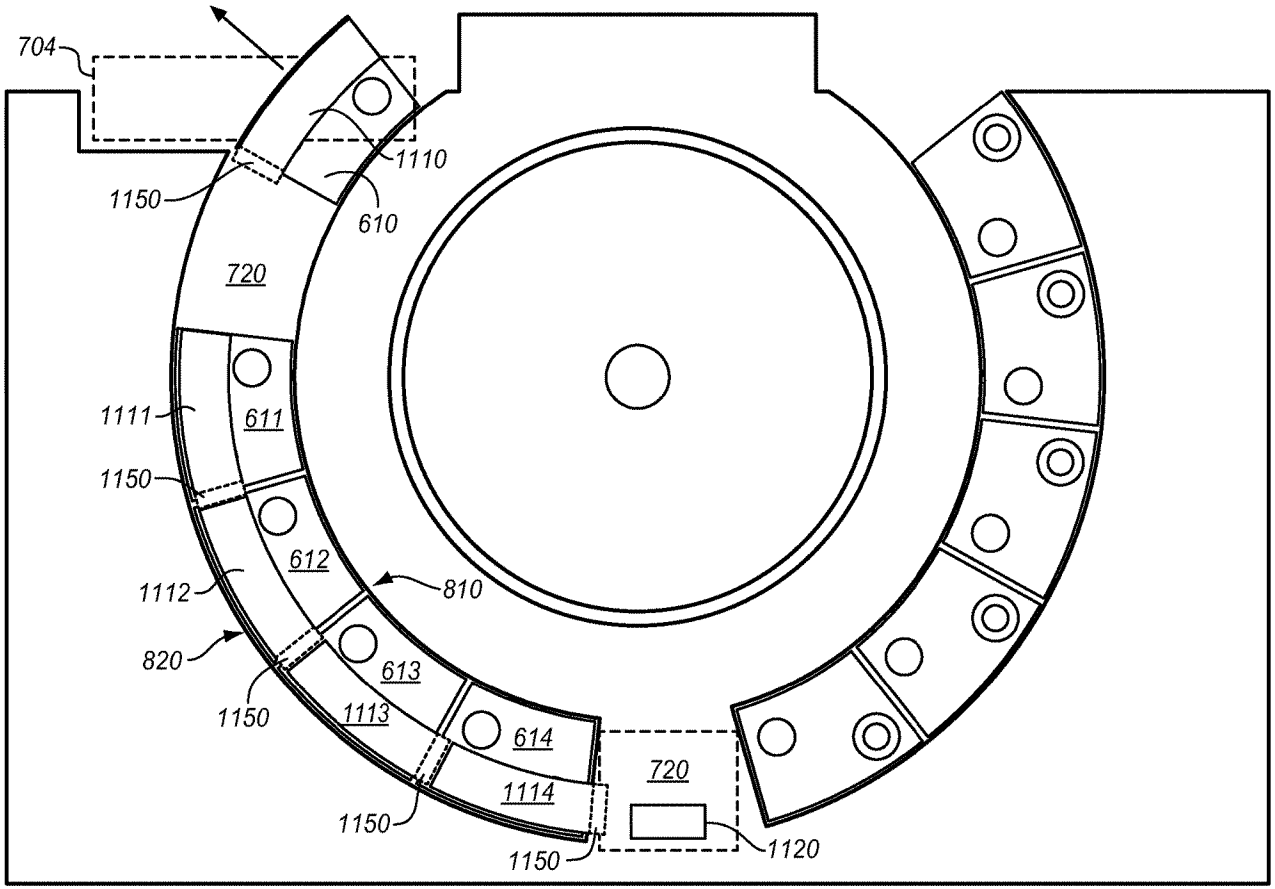
FIG. 11 illustrates a drying system with daisy chained electrical connectors for roller assemblies components in an exemplary embodiment.

FIG. 11 illustrates drying system 300 with daisy chained electrical connectors 1110-1114 for roller assemblies 610-620 in an exemplary embodiment. In this example, terminal section 720 includes a power source 1120 and each roller assembly 610-620 includes an electrical connector 1110-1114 that align with electrical connections of an adjacent roller assembly along arc (and/or track 710/720) to establish a series of electrical connections from power source 1110 for heating at least one roller in each roller assembly 610-620.

The particular arrangement, number, and configuration of components described herein is exemplary and non-limiting. Although specific embodiments were described herein, the scope of the inventive concepts is not limited to those specific embodiments. The scope of the inventive concepts is defined by the following claims and any equivalents thereof.

What is claimed is:

1. A system comprising:

a dryer of a printing system comprising:

a drum configured to rotate about an axis;

first rollers positioned in an arc around the drum to define a web path along the arc between an entrance of the dryer and the drum;

second rollers positioned along the arc and radially between the first rollers and the drum, the second rollers reverse the web path along the arc between the drum and an exit of the dryer;

first web conditioners positioned along the arc and radially beyond the first rollers, the first web conditioners configured to direct web conditioning toward a portion of the web path that is between the entrance of the dryer and the drum; and second web conditioners positioned along the arc and radially between the second rollers and the drum, the second web conditioners configured to direct web conditioning toward a portion of the web path that wraps around the drum.

2. The system of claim 1 wherein:

the first web conditioners include first air knives that direct an air jet toward the portion of the web path that is between the entrance of the dryer and the drum.

3. The system of claim 2 wherein:

the second web conditioners include second air knives that direct an air jet toward the portion of the web path that wraps around the drum.

4. The system of claim 3 wherein:

at least one of the second air knives of the second web conditioners directs an air jet away from the drum and toward a portion of the web path defined by the second rollers.

5. The system of claim 3 wherein:

one or more of the second air knives include a return path to exhaust moist air.

6. The system of claim 2 wherein:

at least one of the first air knives directs a heated air jet toward the portion of the web path that is between the entrance of the dryer and the drum.

7. The system of claim 1 wherein:

the first web conditioners include first heating elements that direct radiant heat toward the portion of the web path that is between the entrance of the dryer and the drum.

8. The system of claim 7 wherein:

the second web conditioners include second heating elements that direct radiant heat toward the portion of the web path that wraps around the drum.

9. The system of claim 1 wherein:

the first web conditioners include a combination of first air knives and first heating elements, wherein the first air knives direct an air jet toward the portion of the web path that is between the entrance of the dryer and the drum, and wherein the first heating elements direct radiant heat toward the portion of the web path that is between the entrance of the dryer and the drum.

10. The system of claim 9 wherein:

the second web conditioners include a combination of second air knives and second heating elements, wherein the second air knives direct an air jet toward the portion of the web path that wraps around the drum, and wherein the second heating elements direct radiant heat toward the portion of the web path that wraps around the drum.

11. The system of claim 10 wherein:

at least one of the second air knives of the second web conditioners directs an air jet away from the drum and toward a portion of the web path defined by the second rollers.

12. The system of claim 10 wherein:

one or more of the first air knives include a return path to exhaust moist air.

13. The system of claim 10 wherein:

one or more of the second air knives include a return path to exhaust moist air.

14. The system of claim 1 wherein:

the first rollers are heated; and the first rollers, the first web conditioners, and one or more of the second web conditioners apply energy toward the web path in an alternating fashion along the arc.

15. The system of claim 1 further comprising:

an enclosure;

wherein a concentric arrangement of components inside the enclosure starting nearest to the drum includes the second web conditioners, the second rollers, the first rollers, and the first web conditioners.

16. The system of claim 1 wherein:

the first web conditioners are offset along the arc relative to the first rollers to direct the web conditioning in spaces between the first rollers and toward the portion of the web path that is between the entrance of the dryer and the drum.

17. The system of claim 1 wherein the dryer further comprises:

a track to partially surround the drum along the arc; and a roller assembly including a frame and at least one of the first rollers and at least one second rollers mounted inside the frame, the frame configured to slide along the track;

wherein the frame is removable from at least one end of the track.

18. The system of claim 17 wherein:

the track configured to support multiple roller assemblies to surround the drum along the arc with the first rollers and the second rollers, wherein each roller assembly includes one of the first rollers and one of the second rollers.

19. The system of claim 17 wherein:

the track includes an inner rail at a first radial distance from the drum, and an outer rail that is a second radial distance from the drum larger than the first radial distance.

20. The system of claim 1 further comprising:

an ink jet printer to apply ink to a web of print media.

* * * * *